US009283456B2

(12) United States Patent
Thomas et al.

(10) Patent No.: US 9,283,456 B2
(45) Date of Patent: Mar. 15, 2016

(54) CONVERTIBLE BASEBALL/SOFTBALL TRAINING EQUIPMENT

(71) Applicants: Mark Thomas, Chesterfield, IL (US); Richard Bertagnolli, Rices Landing, PA (US)

(72) Inventors: Mark Thomas, Chesterfield, IL (US); Richard Bertagnolli, Rices Landing, PA (US)

( * ) Notice: Subject to any disclaimer, the term of this patent is extended or adjusted under 35 U.S.C. 154(b) by 41 days.

(21) Appl. No.: 14/092,877

(22) Filed: Nov. 27, 2013

(65) Prior Publication Data

US 2014/0179465 A1 Jun. 26, 2014

Related U.S. Application Data

(60) Provisional application No. 61/730,377, filed on Nov. 27, 2012.

(51) Int. Cl.

| | |
|---|---|
| ***A63B 69/00*** | (2006.01) |
| ***A63B 69/40*** | (2006.01) |
| ***A63B 63/00*** | (2006.01) |
| *A63B 71/02* | (2006.01) |

(52) U.S. Cl.

CPC ..... *A63B 69/0002* (2013.01); *A63B 63/00* (2013.01); *A63B 69/406* (2013.01); *A63B 63/003* (2013.01); *A63B 71/022* (2013.01); *A63B 2069/0006* (2013.01); *A63B 2069/0008* (2013.01); *A63B 2069/401* (2013.01); *A63B 2071/025* (2013.01); *A63B 2210/50* (2013.01); *A63B 2243/0004* (2013.01)

(58) Field of Classification Search

CPC .... A63B 63/00; A63B 69/40; A63B 69/0002; A63B 69/406

USPC ..... 473/422, 426, 430, 434, 433, 451, 473/454–456, 421, 431; 124/78, 79

See application file for complete search history.

(56) References Cited

U.S. PATENT DOCUMENTS

| | | | | | |
|---|---|---|---|---|---|
| 2,657,058 | A | * | 10/1953 | Mulcahy | 473/436 |
| 2,978,246 | A | * | 4/1961 | Van Groningen | A63B 63/00 473/456 |
| 3,194,556 | A | * | 7/1965 | Vinson | 473/436 |
| 3,583,703 | A | * | 6/1971 | Brown | A63B 63/00 473/456 |
| 4,552,120 | A | * | 11/1985 | Nall et al. | 124/78 |
| 4,657,250 | A | * | 4/1987 | Newland et al. | 473/432 |
| 4,978,121 | A | * | 12/1990 | Larkey | 473/454 |
| 5,222,731 | A | * | 6/1993 | Hanabusa et al. | 473/436 |
| 5,566,934 | A | * | 10/1996 | Black et al. | 473/431 |
| 5,672,125 | A | * | 9/1997 | Ross | 473/421 |
| 6,155,936 | A | * | 12/2000 | Dorr | 473/456 |
| 6,379,272 | B1 | * | 4/2002 | Gorgo et al. | 473/421 |
| 6,620,064 | B2 | * | 9/2003 | Nickerson | 473/431 |
| 7,066,845 | B2 | * | 6/2006 | Joseph | 473/431 |
| 7,137,910 | B2 | * | 11/2006 | Ktson et al. | 473/431 |
| 7,393,291 | B2 | * | 7/2008 | Huang et al. | 473/456 |
| 7,413,521 | B2 | * | 8/2008 | Cherry | 473/451 |

(Continued)

*Primary Examiner* — Mitra Aryanpour

(74) *Attorney, Agent, or Firm* — Gary P. Topolosky

(57) ABSTRACT

Baseball or softball training equipment that is capable of converting from a system for practicing pitching and throwing to a machine for throwing balls to practice batting or fielding. The equipment comprises: a main frame for catching a ball thrown toward the system; foldable backstop components hinged on both sides to the main frame; a plurality of movable, resettable targets connected to the main frame and extending over a ball collecting component; and a ball return component with a motorized wheel situated beneath the ball collecting component and detachably mounted for removing from the main frame and affixing to its own stand.

12 Claims, 5 Drawing Sheets

(56) References Cited

U.S. PATENT DOCUMENTS

| | | | | |
|---|---|---|---|---|
| 7,479,075 | B2 * | 1/2009 | Burruss, Jr. | 473/454 |
| 7,648,431 | B1 * | 1/2010 | Kinkead | 473/454 |
| 7,662,053 | B1 * | 2/2010 | Summers et al. | 473/431 |
| 7,901,305 | B2 * | 3/2011 | Maeda | 473/436 |
| 8,016,699 | B1 * | 9/2011 | Swartzendruber | 473/431 |
| 8,529,382 | B2 * | 9/2013 | Green et al. | 473/454 |
| 8,602,919 | B2 * | 12/2013 | Bishop | 473/421 |
| 2004/0162166 | A1 * | 8/2004 | Tien | A63B 63/06 473/454 |
| 2008/0248901 | A1 * | 10/2008 | Mosier et al. | 473/454 |
| 2014/0179465 | A1 * | 6/2014 | Thomas et al. | 473/436 |

* cited by examiner

CONVERTIBLE BASEBALL/SOFTBALL TRAINING EQUIPMENT

CROSS-REFERENCE TO RELATED APPLICATION

This application is a perfection of U.S. Provisional Patent Application Ser. No. 61/730,377, filed on Nov. 27, 2012, the disclosure of which is fully incorporated by reference herein.

BACKGROUND OF THE INVENTION

1. Field of the Invention

The present invention relates to convertible training equipment for baseball and/or softball players. Particularly, this invention a ball catching and returning machine that easily and rapidly converts to a stand-mounted pitching machine.

2. Description of Related Art

In the past, various ball throwing devices and nets have been used to assist training baseball players with added focus on the pitchers. Some known devices disclose ball throwing using one wheel or, better still, two rotary wheels that are independently adjustable in speed to achieve throwing with a wide variation in velocity and curvature.

One representative ball-throwing machine is disclosed in Paulson Reissue Patent No. 30,703. Its novelty rested on using a pad to compress the balls to be thrown by that machine against the main rotating wheel.

In Lay U.S. Pat. No. 4,883,272, there is shown a ball-catching netted frame that has a ball-expelling machine centrally located to the lower rear base of that netted frame.

Bedord et al U.S. Pat. No. 5,133,548 showed a ball-pitching trainer having a padded cushion along its back chamber wall. After hitting the targeted cushion, pitched balls will ramp down to a ball expelling machine located adjacent the main pitching frame.

A bulky, rather cumbersome ball catching apparatus is taught by Ryker et al U.S. Pat. No. 5,573,239. The front housing to that apparatus includes a plurality of adjustable vertical strips protecting sensors for gauging the accuracy and speed of balls thrown at the apparatus.

Dorr U.S. Pat. No. 6,155,936 is another pitcher's practice target with ball return. This device is meant to focus a pitcher's throws into one of five precise strike zone sub-regions by having them throw through cut out apertures for the regions in question.

The ball training system and method of Joseph U.S. Pat. No. 7,066,845 includes a netted frame onto which mapped a square throwing target divided into quadrants. Each ball thrown at that system rolls down a ramp to a ball return positioned adjacent the main frame.

Finally, the focus of Ktson et al U.S. Pat. No. 7,137,910 is on a ball return mechanism for a target-less, framed netting backstop.

There is no known art that provides all aspects of the present invention, i.e. a portable training device which is easily converted into a separate pitching unit, apart from its primary use as a pitching/throwing trainer. This invention provides four target plates for a baseball or softball pitcher to throw at, all four resting fully inside the typical batter strike zone. Upon hitting the practice target with a thrown pitch, that target will "open" and allow the ball to pass to a catching component that can be adjusted for returning the ball to its thrower as a grounder, line drive or pop fly.

SUMMARY OF THE INVENTION

It is a primary object of the invention to overcome the problems of prior art devices by providing ball catching and returning equipment with multiple adjustments and means for extracting the ball return for mounting onto a separate stand.

In one aspect, the invention comprises a baseball or softball training system with four resettable targets, a collector for collecting balls thrown at the targets, a throwback unit associated with said collector for returning collected balls back to its thrower, said throwback unit comprising a base, a drive motor mounted on said base, a wheel coupled to said drive motor, and a guide, at least one of said wheel or said guide being adjustable to permit practicing the receipt of various ball return forms, i.e. grounders, line drives and/or pop ups.

In another aspect, the invention comprises means for easily extracting the ball returning component from the rest of the practice equipment and situating same on a separate stand thereby rapidly converting a sub-element of this device into a pitching, or pitch-throwing, machine for hitting practice.

In yet another aspect, an optional embodiment would include a bracket for adding a speed detection device (or radar gun).

BRIEF DESCRIPTION OF THE DRAWINGS

These features, objects and advantages of the present invention will be apparent from the following description made with reference to the accompanying drawings in which:

FIG. 7 is a left side perspective view of the folded equipment from FIG. 6 with rear equipment protection netting left on;

DESCRIPTION OF PREFERRED EMBODIMENTS

Figure 1:
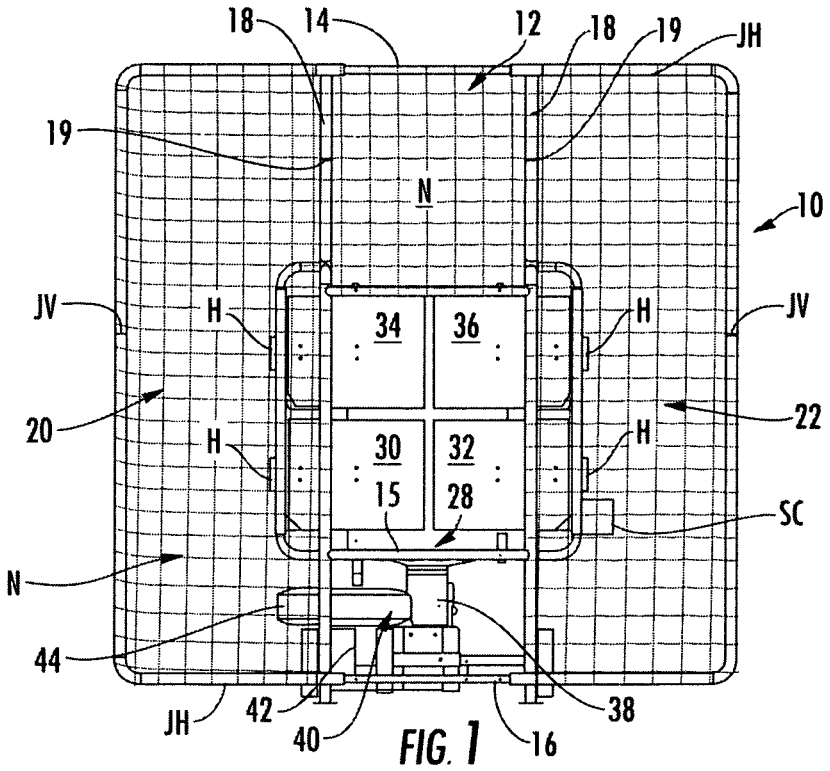
FIG. 1 is a front plan view of one embodiment of training equipment with the netted side backstops hinged open on both sides of the central catching/throwing component.
Figure 2:
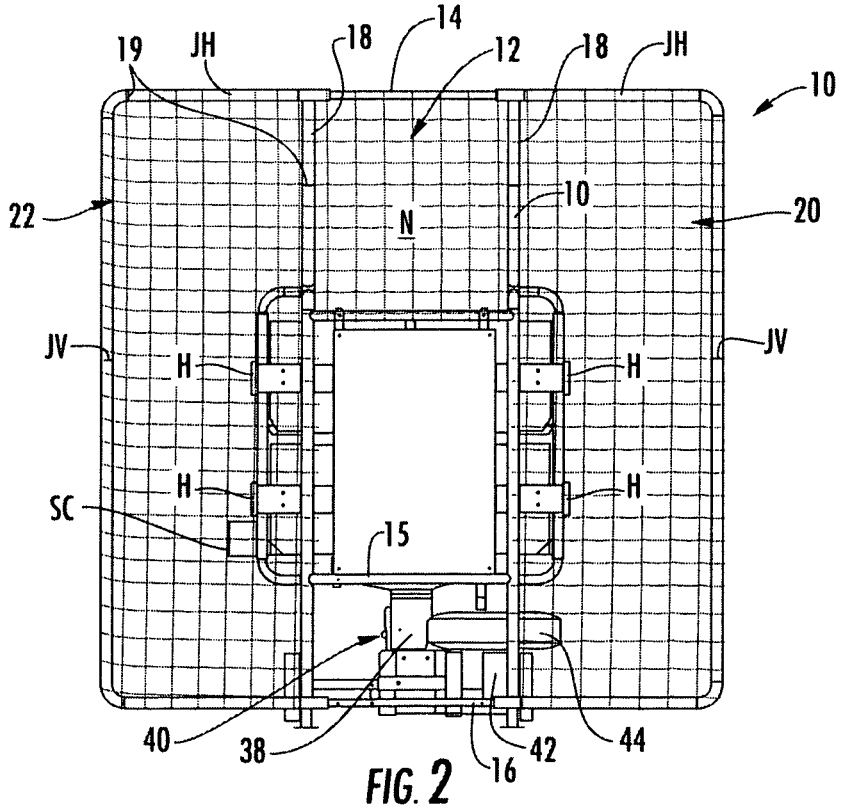
FIG. 2 is a rear plan view of the equipment from FIG. 1.
Figure 3:
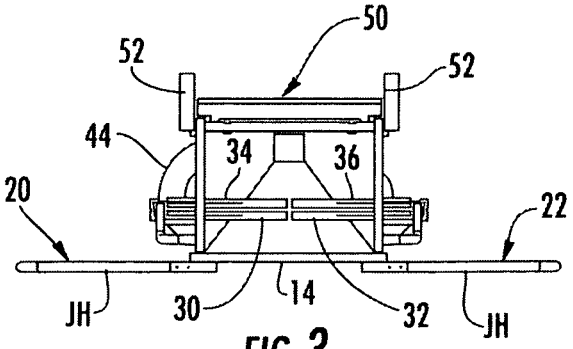
FIG. 3 is a top plan view of said equipment.
Figure 4:
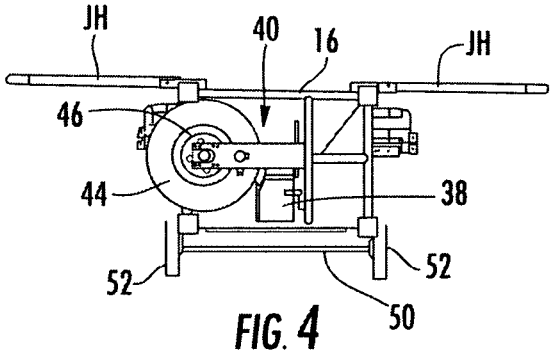
FIG. 4 is a bottom plan view of the same.
Figure 5:
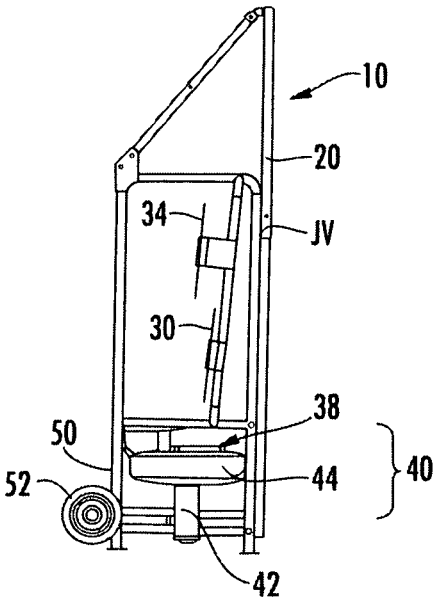
FIG. 5 is a left side plan view of said equipment.
Figure 6:
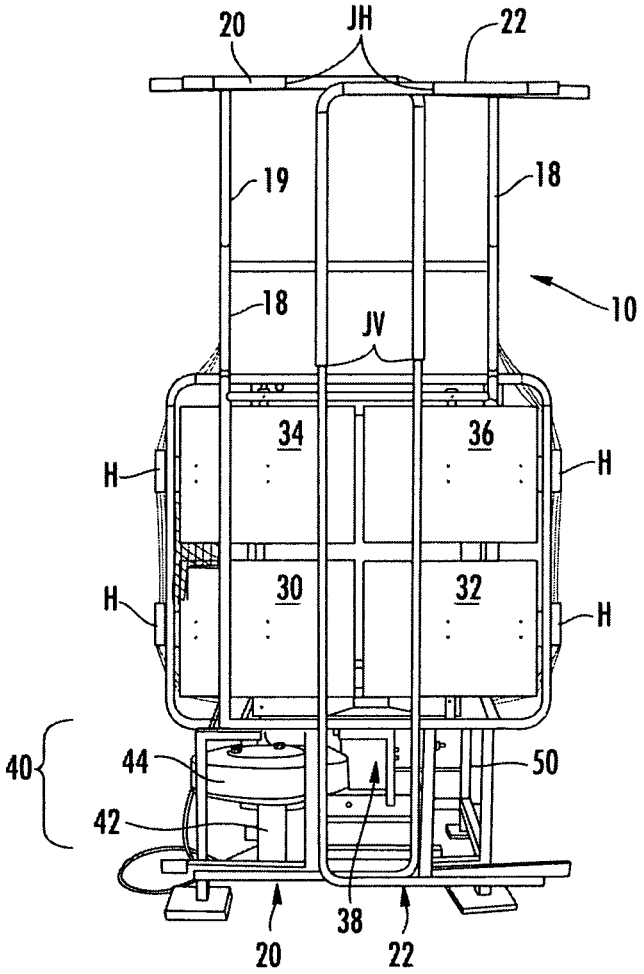
FIG. 6 is a front plan view the equipment from FIG. 1 with side backstops vertically raised then folded inward for transport (and with netting removed for illustration purposes)
Figure 7:
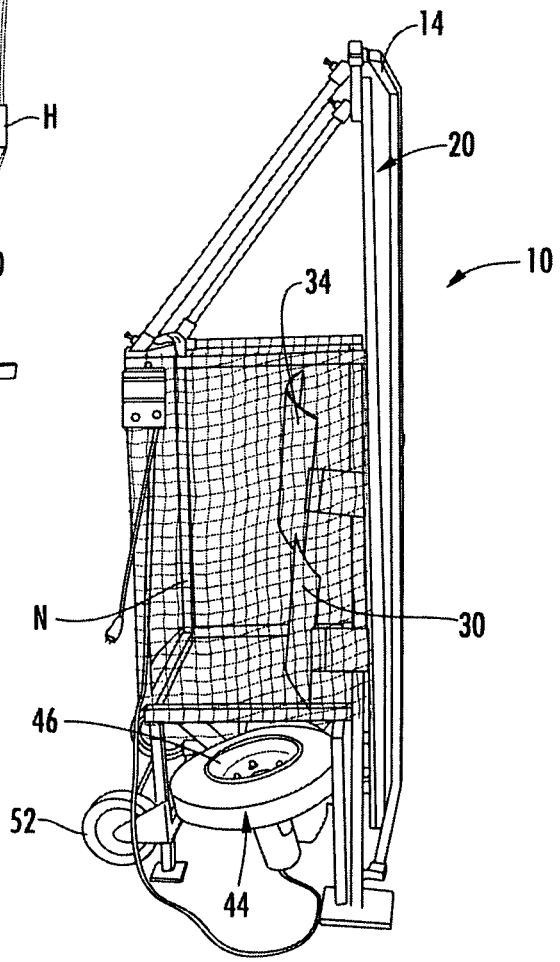
Figure 8:
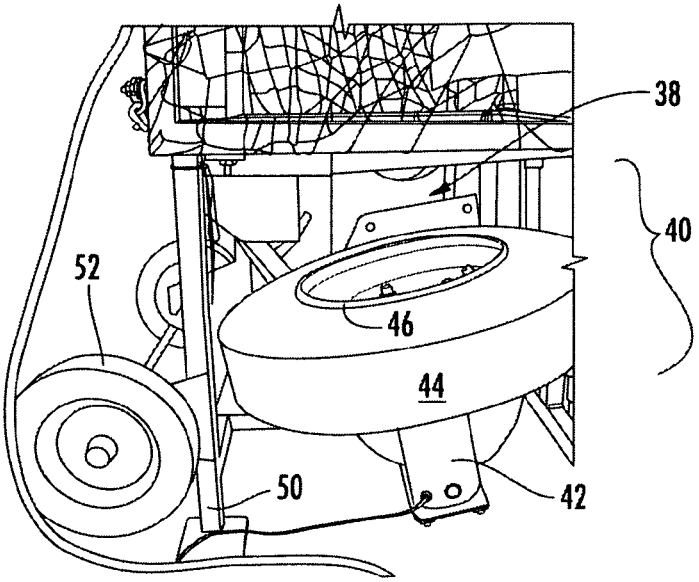
FIG. 8 is a side perspective close up of the ball return wheel component from FIG. 7.

Referring now to FIGS. 1 through 7, there is shown a baseball/softball training system, generally 10, according to this invention. System 10 includes a collapsible ball collector or main frame 12 with a top bar 14, intermediate crossbar 15, bottom bar 16 and side bars 18, the latter two having a bar-within-a-bar sleeve arrangement (indicated by joint 19) in order for the unit to be compacted for transport and expanded, as needed, for use on an indoor practice area or outdoor field.

On both sides of main frame 12 are "side wing" backstops 20 and 22 with their own frame joints for vertical expansion JV and/or horizontal expansion JH. In some of the views, there is also shown netting N for wrapping to or about respective frame components. When not using the ball returning components of system 10, netting may be run from below crossbar 15 to bottom bar 16. But in most cases, that region is left open for collected balls to be returned to fielders/pitchers for practice. In some of the accompanying views, that netting is fully or partially removed for illustration purposes only. Alternately, steel or composite screen can be used instead of netting.

There are several places in which main frame 12 may be hinged to backstops 20, 22, at or near top bar 14 and bottom bar 16. Those hinges, generally H, may be supplemented with or substituted using a plurality of hinges at various points along both sidebars 18. When folded "open" and properly adjusted for the correct height/width of users for practicing, the system 10 defines/creates a ball collecting area, generally 28, with its own set of resettable targets at which a player, such as a pitcher or fielder, may throw a ball. In the accompanying FIGS, there are shown four representative targets, two lower targets 30, 32 and two upper targets 34, 36. The upper targets 34, 36 are situated above and slightly more rearward of lower targets 30, 32 as best seen in accompanying FIG. 5, though it is to be understood that the order or target depth can be reversed and/or the total number of throwing targets increased or decreased from four total. The above quantity is merely representative and helps train a pitcher to practice throwing in four main quadrants, left high and low versus right high and low (with left and right being determined by the direction of throwing and, not necessarily, in which direction a batter may be facing).

System 10 further comprises a throwback unit 40 situated directly beneath ball collection area 28. That unit includes a drive motor 42 and rimmed wheel 44 rotatably mounted on a hub 46 driven by drive motor 42. Throwback unit 40 also includes brackets (not shown) for adjusting the manner in which balls may be returned to the thrower. All components of system 10 are intended to accommodate different sized balls such as girls' baseballs, softballs and boys' baseballs or softballs.

Advantageously, this invention provides convenient training means having a readily portable, collapsible ball collecting area 28 and multiple-positioning ball return or throwback unit 40. During use, a player may throw his/her ball toward one of several targets or target plates. All preferred targets should be situated within (inside) a typical batter's strike zone with emphasis on throwing inside high, inside low, outside high and outside low in that zone. When a thrown ball hits a particular target, that target will swing (or otherwise move) "open" and let the ball pass through for falling into the system's collecting area 28. The target that was "hit" then automatically resets to its original position as an angled floor causes the thrown ball to be directed toward a feed guide track, shaft or trench 38 adjacent return wheel 44 of throwback unit 40.

System 10 can be used to return balls to just one thrower (a pitcher or fielder), or to several practice players, by adjusting the location of throwback unit 40. It can also be used as an instructional fielding trainer by adjusting throwback unit to serve ball returns along different trajectories and angles relative to the ball collecting area 28. With adjustments, the system 10 can return balls as line drives, shallow pop-ups and/or ground balls.

A removable backstop, covered in netting, catches throws/pitches that are not within the system's pitching "strike zone". One representative backstop measured 76×74.75 inches and attached, with bolts and braces, to the main catching unit in four main spots. This backstop can be folded to a smaller dimension either on or off the main practice unit. To assist with transport, the rear of the unit includes a cart/dolly arrangement 50 with a plurality of transportation-assisting wheels 52.

Figure 9:
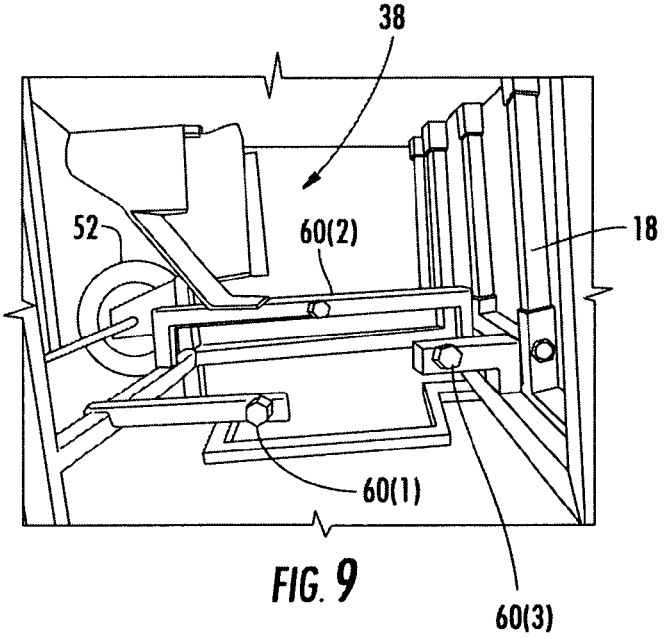
FIG. 9 is a close up perspective focusing on the three bolts that hold the ball return wheel beneath the ball catching component.
Figure 10:
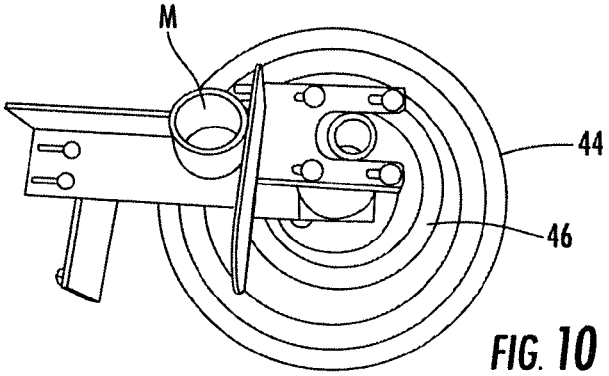
FIG. 10 is a close up perspective showing that portion of the ball return wheel before being slid onto its own stand for serving as a ball pitching machine.
Figure 11:
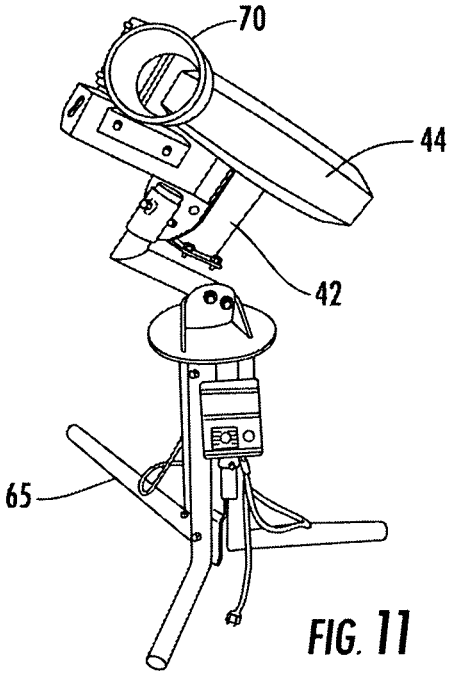
FIG. 11 is a front perspective view of the converted ball pitching machine.
Figure 12:
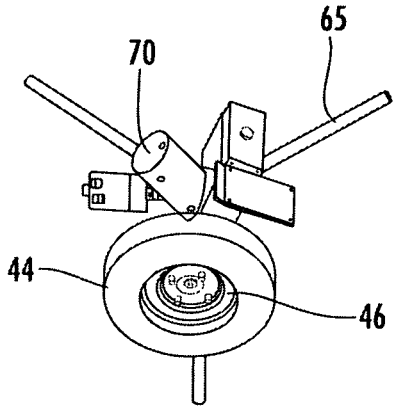
FIG. 12 is a top perspective view of the converted ball pitching machine from FIG. 11.
Figure 13:
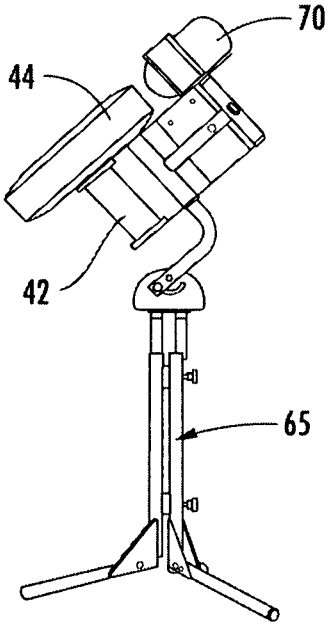
FIG. 13 is a rear perspective view of the ball pitching machine from FIG. 11.
Figure 14:
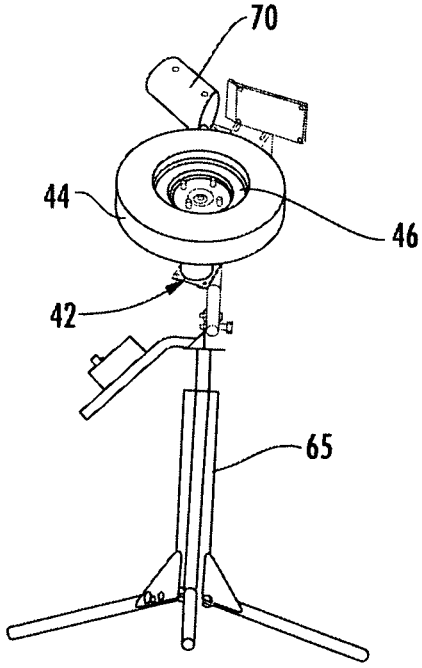
FIG. 14 is a right side perspective view of that same ball pitching machine.

FIG. 9 shows the three bolts 60 (1) through (3) that are all that are required for quickly and rather easily extracting the ball return from beneath collecting area 28. Once separated from main frame 12, the ball return motor 42 and wheel 44 can be mounted, with mount post M onto a separate stand 65 as seen in accompanying FIGS. 10 through 14. Launcher shoot 70 to the latter unit can then be separately adjusted to throw drop balls, fastballs and balls that break left or right (curveballs) for hitting practice.

On a preferred basis, the equipment includes a speed controller SC for manipulating the speed of balls thrown from either the catch-and-return unit or from its setup as a hitting practice machine so as to better accommodate users of different age and/or different skill levels. Preferably, that speed controller (such as a radar gun) would be situated behind protective netting of some sort. Such a controller may be added through frame bracketing. With a typical radar gun, the speed of pitches thrown at this equipment may be measured and displayed.

While the system and method described herein constitute preferred embodiments of this invention, it is to be understood that the invention is not limited to this precise system and method, and that changes may be made in either without departing from the scope of the inventions, which is defined in the appended claims.

What is claimed is:

1. A baseball or softball training system comprising, in combination:

a main frame for catching a ball thrown toward the system;

foldable backstop components hinged on both sides to the main frame;

four quadrant targets, each target: (i) being situated in a simulated batter's strike zone, (ii) connected to the main frame; (iii) adapted for swinging inwardly on contact with a thrown ball then automatically resetting for a next throw; and (iv) extending over a ball collecting component; and a ball return component having a motorized wheel situated beneath the ball collecting component and detachably mounted for removing from the main frame and affixing to a separate stand for serving as a practice pitching machine.

2. The training system of claim 1, which further comprises means for varying speed at which each ball is returned to a thrower through the system.

3. The training system of claim 1, which further includes a support bracket for a radar unit.

4. The training system of claim 1, which includes one or more adjustable brackets for changing the angle of ball return to effect a grounder, line drive or pop fly.

5. The training system of claim 1, which includes an upper pair and a lower pair of throwing targets.

6. Baseball or softball training equipment that is capable of converting from a system for practicing pitching and throwing to a machine for throwing balls to practice batting or fielding, said equipment comprising:

a main frame for catching a ball thrown toward the system;

foldable backstop components hinged on both sides to the main frame;

two upper quadrant and two lower quadrant targets, each target: (i) being situated in a simulated batter's strike zone, (ii) connected to the main frame; (iii) adapted for swinging inwardly on contact with a thrown ball then automatically resetting for a next throw; and (iv) extending over a ball collecting component; and a ball return component having a motorized wheel situated beneath the ball collecting component and detachably mounted for removing from the main frame and affixing to a separate stand.

7. The training equipment of claim 6, which further includes a support bracket for a radar unit.

8. The training equipment of claim 6, which includes adjustable brackets for changing the angle of ball return to effect a grounder, line drive or pop fly.

9. The training equipment of claim 6, which has vertically adjustable backstop extensions.

10. The training equipment of claim 9 wherein said extensions are at least partially covered with netting or screen.

11. The training equipment of claim 6, which has horizontally adjustable backstop extensions.

12. The training equipment of claim 11 wherein said extensions are at least partially covered with netting or screen.

* * * * *